US006543403B2

(12) United States Patent
Kawamoto

(10) Patent No.: US 6,543,403 B2
(45) Date of Patent: Apr. 8, 2003

(54) AUTOMATIC DECOMPRESSION DEVICE

(75) Inventor: Yuichi Kawamoto, Akashi (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 50 days.

(21) Appl. No.: 09/771,852

(22) Filed: Apr. 25, 2001

(65) Prior Publication Data

US 2002/0157631 A1 Oct. 31, 2002

(51) Int. Cl.[7] ..... F01L 13/08
(52) U.S. Cl. ..... 123/182.1
(58) Field of Search ..... 123/182.1

(56) References Cited

U.S. PATENT DOCUMENTS 4,590,905 A * 5/1986 Matsuki et al. ..... 123/182.1
4,615,313 A * 10/1986 Tsumiyama ..... 123/182.1
6,250,271 B1 * 6/2001 Ikuma et al. ..... 123/182.1
6,269,786 B1 * 8/2001 Snyder et al. ..... 123/182.1

FOREIGN PATENT DOCUMENTS

JP 59-130011 8/1984
JP 6 280532 A1 * 10/1994

* cited by examiner

*Primary Examiner*—Henry C. Yuen
*Assistant Examiner*—Arnold Castro
(74) *Attorney, Agent, or Firm*—Marshall, Gerstein & Borun

(57) ABSTRACT

In an automatic decompression device of a small OHC-type engine, a decompression control mechanism A comprises a weight member 5 including a pivot portion 5A pivotably attached to a cam shaft 20 at a position apart from a center axis O20 of the cam shaft and having an outer periphery curved along an outer periphery of a cam sprocket 15 and a tip end portion that engages with an operating shaft 1, to swing around the pivot portion 5A outwardly by rotation of the cam shaft 20; and a bias member (coil spring 17) for biasing a portion of the weight member 5 that is apart from the pivot portion 5A toward the center axis of the cam shaft 20 in a swing area, wherein the tip end portion 5C of the weight member 5 that engages with the operating shaft is situated on an opposite side of the pivot portion 5A with respect to the center axis O20 of the cam shaft 20.

11 Claims, 5 Drawing Sheets

AUTOMATIC DECOMPRESSION DEVICE

BACKGROUND OF THE INVENTION

1. Field of the Invention

The present invention relates to an automatic decompression device of a small OHC (Overhead Cam) type engine suitable for a motor cycle, a small all terrain vehicle (hereinafter also referred to as ATV), a snow mobile, a small leisure vehicle, a personal watercraft, or the like.

2. Description of the Related Art

Small OHC-type engines (hereinafter also referred to as small engines) are mounted on some of motor cycles, small all terrain vehicles (small ATV), snow mobiles, small leisure vehicles, personal watercrafts, and the like. Some of the small engines are provided with decompression devices for reducing pressure to reduce staring torque when the engines are starting.

In recent years, there has been developed and adopted an automatic decompression device that is automatically activated when the number of revolutions of an engine is below a predetermined number of revolutions. An example of a prior art is Application for Japanese Utility Model Registration. No. Sho. 58-24605 (Publication for Japanese Utility Model. No. Sho. 59-130011) filed by the applicant of the present invention.

In principle, the automatic decompression device is formed such that when the number of revolutions of a cam shaft of the engine is below a predetermined number of revolutions, a "decompression lifter" protrusibly provided inwardly of a cam face for exhaust is protruded, and a locker arm for exhaust is thereby activated to allow an exhaust valve to be slightly "Open" to make an interior of a cylinder opened in atmosphere to cause a pressure in the cylinder to be reduced, thereby reducing starting torque of the engine.

By the way, it is required that the above-described conventional automatic decompression device be activated only at a low velocity of not more than the predetermined number of revolutions (the number of revolutions in an idling state) and be in a non-operating state at a velocity of not less than the predetermined number of revolutions, because the decompression device needs to reduce the starting torque. Accordingly, to make it possible that a decompression control mechanism provided at one end of the cam shaft is reliably activated at a low speed, i.e., reliably performs switching, in operation of the decompression lifter, the mechanism is provided with an arm-shaped change member passing through a center of the cam shaft and substantially as large as a diameter of a cam sprocket to sense a centrifugal force generated by the revolution of the cam shaft with the high sensitivity. For this reason, a dimension (dimension in a longitudinal thereof) of the change member of the decompression control mechanism is increased. Also, to operate the change member when the number of revolutions of the cam shaft exceeds the predetermined number of revolutions for release of the decompressed state, a link member is swingably provided such that it engages with a cam groove provided at an end portion of the change member and swings by the centrifugal force. The link member is biased by a spring to be swung only when the number of revolutions of the cam shaft exceeds the predetermined number of revolutions.

Consequently, the whole decompression control mechanism, and hence a cylinder head portion of the engine become large. Such an engine is unsuitable as the small engine because it is voluminous. Also, the engine is mounted at a limited position because a space around the cylinder head portion of the engine is small when employed as the small engine for the straddle-type vehicle such as the ATV, the motor cycle, or the personal watercraft. Besides, in the conventional automatic decompression device, since the number of parts and the man-hour for assembly thereof are increased because of its complex mechanism, its cost is correspondingly high.

SUMMARY OF THE INVENTION

Under the circumstances, an object of the present invention is to provide an automatic decompression device which is compactly designed and can reduce the number of parts.

According to the present invention, there is provided an automatic decompression device of a small OHC-type engine in which a decompression lifter provided inwardly of an exhaust cam face of a cam shaft in a radial direction of the cam shaft such that the decompression lifter is outwardly protrusible or inwardly retractable in the radial direction from the cam face, for operating by rotational operation of an operating shaft inserted in the cam shaft is protruded by a decompression control mechanism when the number of revolutions of the cam shaft is below a predetermined number of revolutions, to allow an exhaust locker arm to be operated, for reducing a pressure in a cylinder when the engine is starting, wherein the decompression control mechanism comprises: a weight member including a pivot portion pivotably attached to the cam shaft at a position apart from a center axis of the cam shaft and having an outer periphery curved along an outer periphery of a cam sprocket and a tip end portion that engages with the operating shaft, to outwardly swing around the pivot portion by rotation of the cam shaft; and a bias member for biasing a portion of the weight member that is apart from the pivot portion toward the center axis of the cam shaft in a swing area of the weight member, wherein the tip end portion of the weight member that engages with the operating shaft is situated on an opposite side of the pivot portion with respect to the center axis of the operating shaft.

According to the automatic decompression device of the small OHC-type engine configured as described above, since a rotational angle of the weight member required for rotating the operating shaft in a desired angle can be made small, a swing area (swing angle )of the weight member can be reduced. Consequently, the decompression control mechanism has a compact outer shape and the cylinder head portion of the small OHC-type engine can be made compact. Therefore, this engine is suitable as the engine of the straddle-type vehicle such as the motor cycle, the ATV, and the personal watercraft. Further, since the number of parts is reduced, the man-hour for assembly can be reduced, and the cost is low.

It is preferable that in the automatic decompression device, a pair of weight members are provided at a periphery of the cam shaft such that the weight members are symmetric with respect to the center axis of the cam shaft and the bias member is placed between the pair of weight members to bias the weight members to be close to each other, thereby biasing the weight members toward the center axis of the cam shaft in the swing area. With this configuration, the weight members can be made smaller and more compact. Also, this configuration is preferable in terms of dynamic balance.

It is preferable that in the automatic decompression device, the cam sprocket is integrally attached to an end portion of the cam shaft, the weight member is pivotally attached to a side face of the cam sprocket, a restricting protrusion is formed on the side face of the cam sprocket for restricting a swing area of the weight member, and an abutment portion that abuts with the protrusion is formed on the weight member.

It is preferable that in the automatic decompression device, the weight members are provided opposite to each other and one of the restricting protrusions that restricts swing of one of the weight members is formed of a portion of the other weight member. This configuration is preferable because the number of parts can be reduced and the device can be made compact.

DETAILED DESCRIPTION OF THE PREFERRED EMBODIMENTS

An automatic decompression device of a small OHC-type engine according to an embodiment of the present invention will be described with reference to accompanying drawings.

Figure 1:
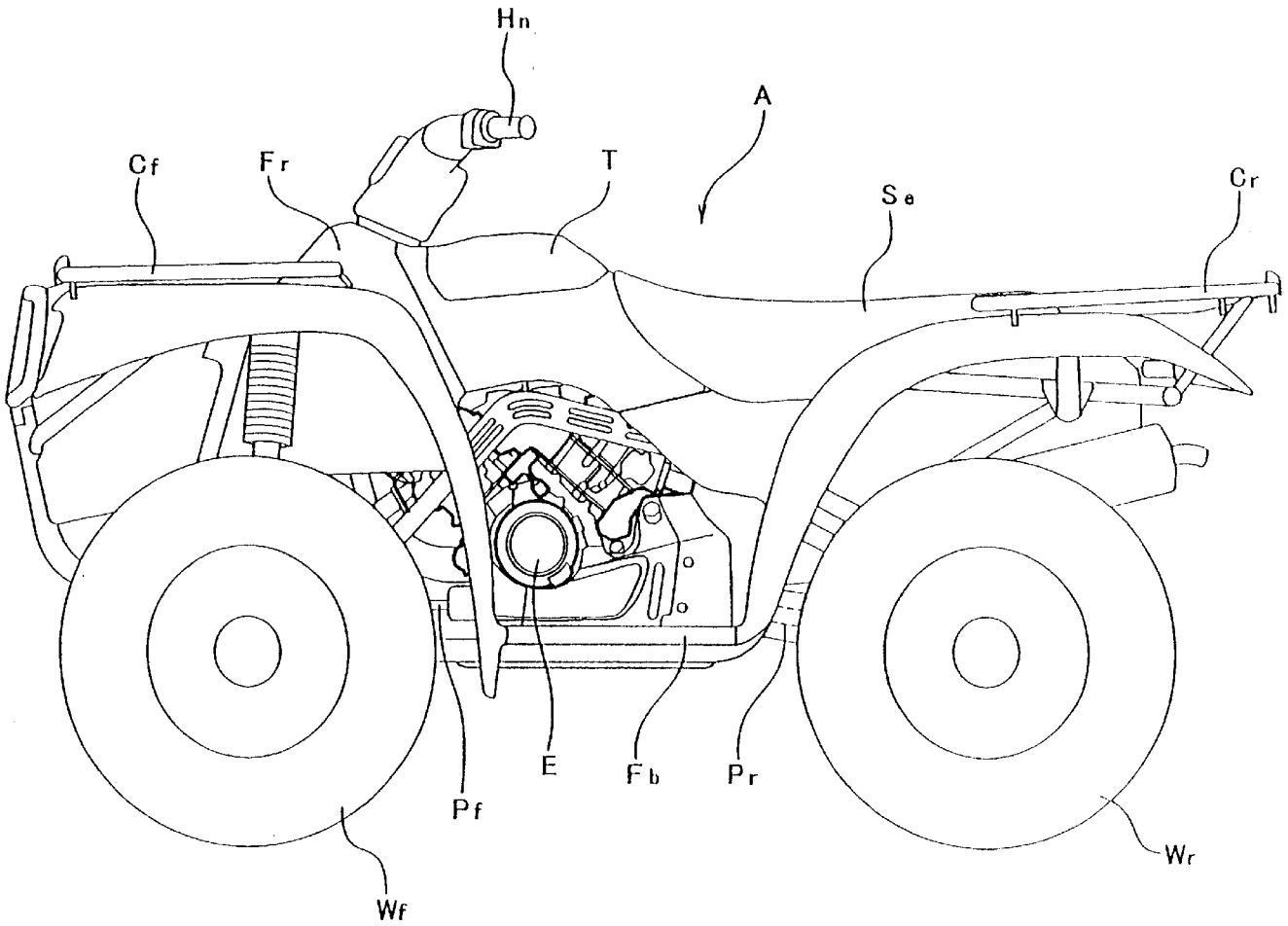
FIG. 1 is a whole side view showing an all terrain vehicle on which a small OHC-type engine having an automatic decompression device according to an embodiment of the present invention is mounted.

Referring now to FIG. 1, a straddle-type four wheel all terrain vehicle A comprises a steering bar handle Hn rotatably attached to a vehicle body Fr, right and left front wheels Wf, and right and left rear wheels Wr. The straddle-type four wheel all terrain vehicle A further comprises a forward carrier Cf placed forward of the handle Hn, a cover T placed rearward of the handle Hn, a straddle-type seat Se placed rearward of the cover T, a rearward carrier Cr placed rearward of the seat Se, and foot boards Fb provided on opposite sides situated forward and downward of the seat Se and at positions substantially as high as axles of the front wheels Wf and the rear wheels Wr. The vehicle A is provided with a V-type two cylinder small OHC four cycle engine (hereinafter also referred to as a V-type engine) E having a reduced width and a compact cylinder head portion, below the cover T such that a lower end thereof is substantially as high as the foot boards Fb. Two cylinders of the V-type engine E are placed forward and rearward such that they are inclined to make an angle between them in a forward and rearward direction.

The V-type engine E is adapted to drive the front wheels Wf or the rear wheels Wr via a torque converter, a transmission gear unit, a forward output shaft Pf or a rearward output shaft Pr respectively provided in the forward or rearward direction, and a differential unit (not shown).

In so configured straddle-type four wheel all terrain vehicle A, a rider straddles the seat Se, put the rider's feet on the foot boards Fb provided right and left, and grips the handle Hn with both hands to steer the vehicle A. It is therefore preferable that the width of the engine E is reduced and the cylinder head portion is compact, because the rider can easily straddle the vehicle and a degree of freedom of a position at which the engine is mounted is increased.

The small OHC-type engine is provided with the automatic decompression device comprising a decompression control mechanism structured as described below.

Figure 2B:
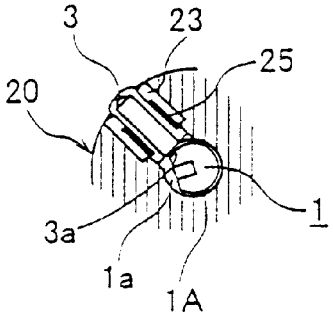
FIG. 2B is a partially enlarged view showing a structure of a main portion in the operating state of the decompression control mechanism according to the embodiment and showing an upper half portion of a decompression lifter taken in the direction of the arrows substantially along the line IIb—IIb of FIG. 4 when the decompression control mechanism is in the operating state of FIG. 2A.
Figure 3B:
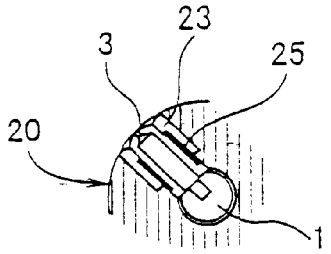
FIG. 3B is a partially enlarged view showing a structure of a main portion in the non-operating state of the decompression control mechanism according to the embodiment and showing an upper half portion of the decompression lifter taken in the direction of the arrows substantially along the line IIb—IIb of FIG. 4 when the decompression control mechanism is in the state of FIG. 3A.
Figure 4:
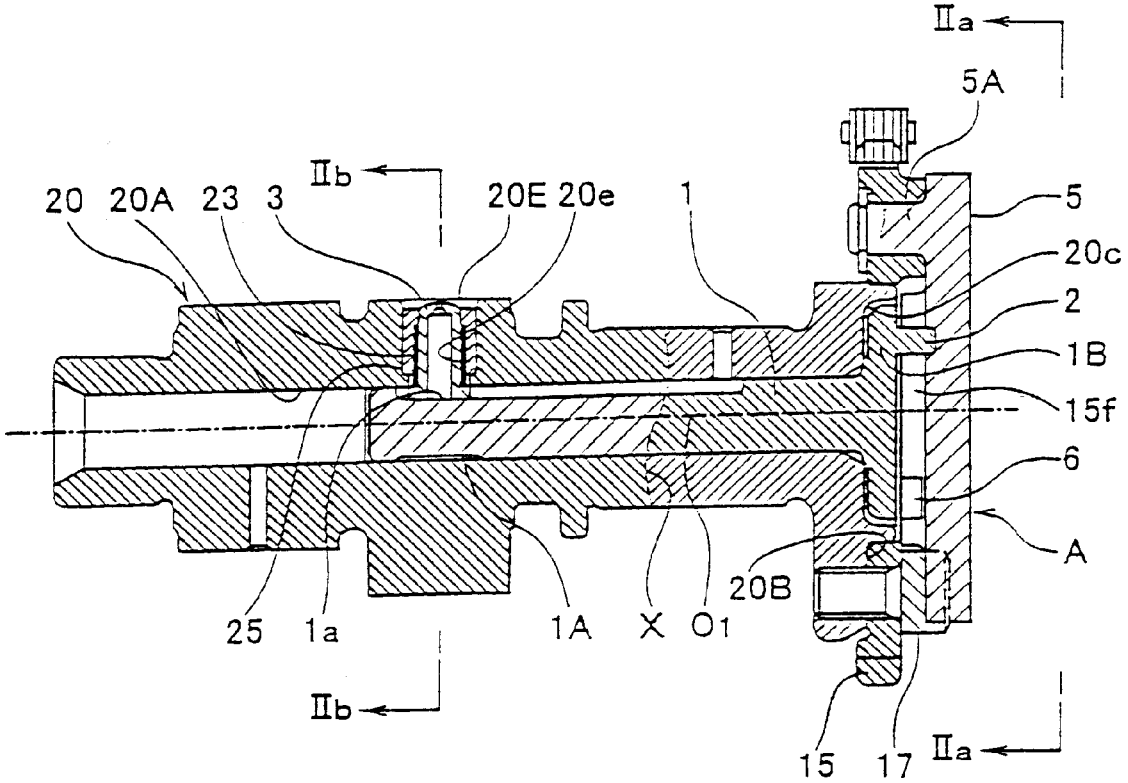
FIG. 4 is a cross-sectional view showing a structure of the whole automatic decompression device, in which a left-side portion situated leftward from a break line X shows a cross section of a cam shaft cut in a longitudinal direction thereof and a right-side view situated rightward from the break line X is a cross section taken in the direction of the arrows substantially along the line IV—IV of FIG. 2.
Figure 5:
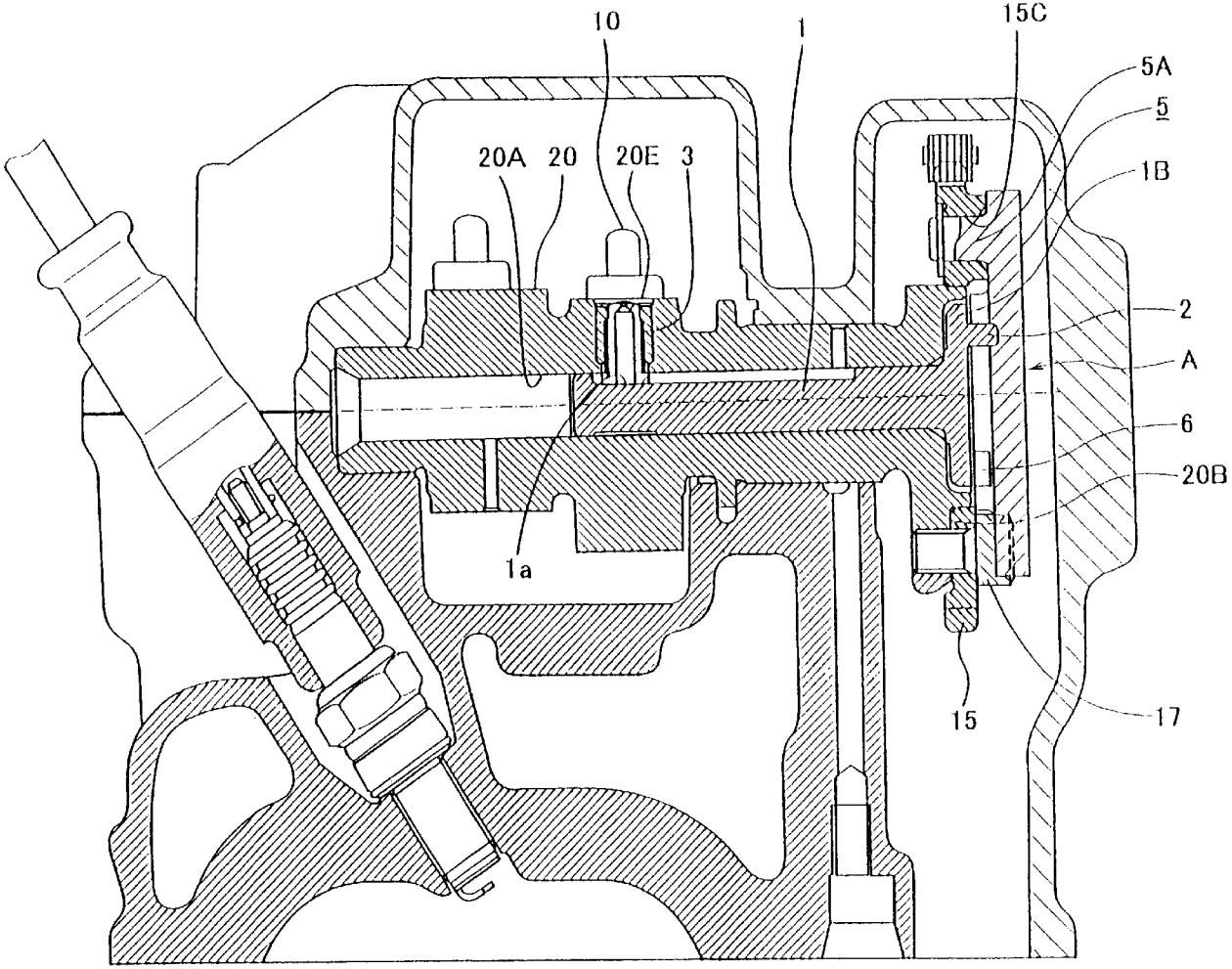
FIG. 5 is a cross-sectional view showing a cylinder head portion of a small OHC engine which employs the automatic decompression device shown in FIGS. 1–3B.

Referring to FIGS. 4, 5, a penetrating hole 20A is formed in a center axis portion of a cam shaft 20. An operating shaft 1 is inserted into the penetrating hole 20A. In this embodiment, a tip end portion of the operating shaft 1 is extended to a portion of the cam shaft 20 at which a cam face 20E for exhaust is formed. A flat face portion 1*a* obtained by cutting the operating shaft 1 in a crescent shape is formed at a tip end portion of the operating shaft 1. When a partial circumferentia1 face 1A including the flat face portion 1*a* is slidably in contact with a bottom face 3*a* of a decompression lifter 3 and the flat portion 1*a* is in abutment with the bottom face 3*a* of the decompression lifter 3 as shown in FIGS. 4, 2B , a tip end portion of the decompression lifter 3 is accommodated inwardly of the cam face 20E for exhaust (see FIG. 3B) in a radial direction of the cam shaft 20. On the other hand, when a circumferential portion of the partial circumferential face 1A is in abutment with the bottom face 3*a* of the decompression lifter 3, the tip end portion of the decompression lifter 3 is protruded outwardly in the radial direction of the shaft 20 from the cam face 20E for exhaust (see FIG. 2B).

A cam sprocket 15 for driving the cam shaft 20 is fixed to a base end face 20B (right end face in FIGS. 4, 5) of the cam shaft 20 by means of a hexagon socket head cap screw 17. A decompression control mechanism A is provided at a base end portion of the cam shaft 20 for activating the decompression lifter 3. Hereinafter, the decompression control mechanism A will be described in detail.

Referring to FIGS. 2 through 5, a cylindrical concave portion 20*c* is formed in the base end face 20B of the cam shaft 20 around the center axis of the shaft 20. A flange portion 1B formed at the base end portion of the operating shaft 1 is accommodated in the concave portion 20*c*. The flange portion 1B is provided with two engagement pins 2 such that they are protruded from the flange portion 1B in a longitudinal direction of the shaft 20 with a center of rotation O1 situated between these pins 2.

Two penetrating holes 15C are formed in outer peripheral portions of the cam sprockets 15 with the center of rotation O1 situated between these holes 15C.

A pivot portion 5A of a weight member S is rotatably mounted to each of the penetrating holes 15C. The weight member 5 is adapted to swing within a predetermined angle (swing area) around the pivot portion 5A. Specifically, in this embodiment, the weight member 5 is capable of swinging within the predetermined angle (swing area) from a state in which the member 5 is situated inwardly in the radial direction as shown in FIG. 2A to a state in which the member 5 is situated outwardly in the radial direction as shown in FIG. 3A.

Figure 2A:
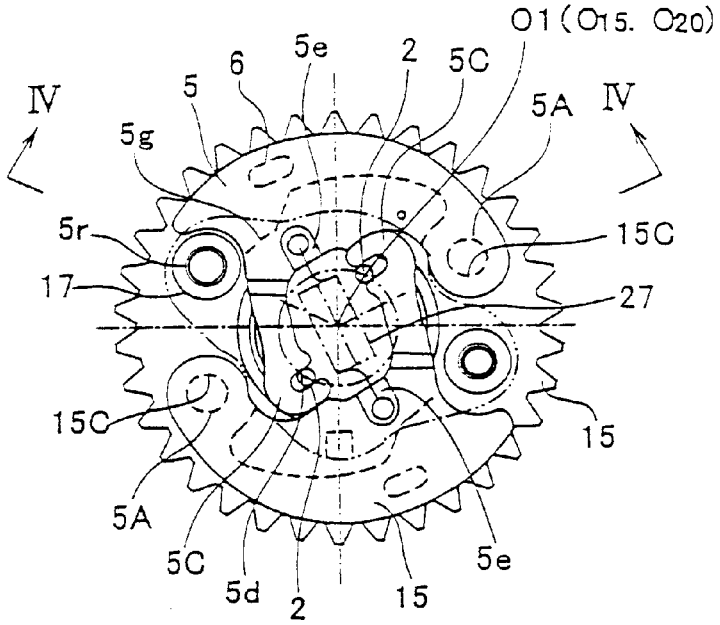
FIG. 2A is a side view showing a structure of a main portion in an operating state of a decompression control mechanism according to the embodiment and showing the main portion of the decompression control mechanism taken in the direction of the arrows substantially along the line IIa—IIa of FIG. 4.
Figure 3A:
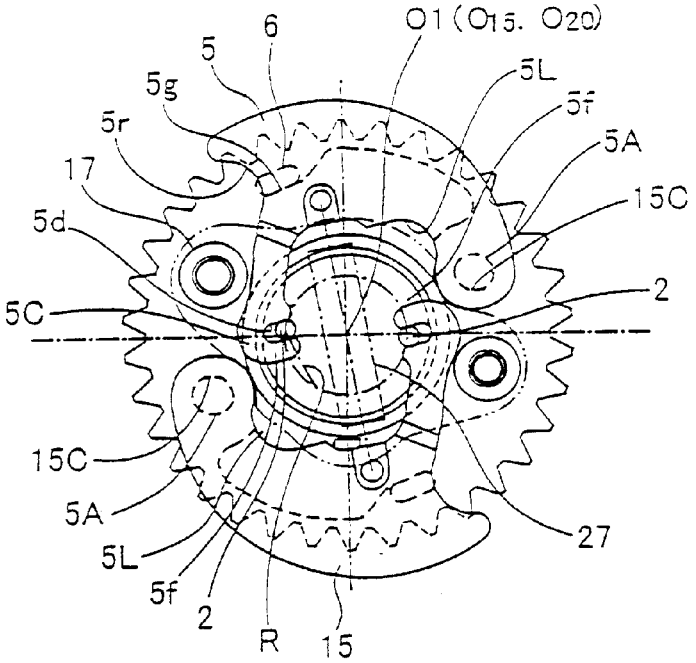
FIG. 3A is a side view showing a structure of a main portion in a non-operating state of the decompression control mechanism according to the embodiment.

As shown in FIGS. 2A, 3A, the weight member 5 has an outer periphery having a curvature radius somewhat smaller than a curvature radius of an outer periphery of the cam sprocket 15. A tip end portion 5C of the weight member 5 is situated on an opposite side of the pivot portion 5A with respect to a center axis O20 (identical to a center of rotation O15) of the cam shaft 20. An engagement groove 5*d* which engages with the engagement pin 2 is formed at the tip end portion 5C. The engagement groove 5*d* is formed in a direction orthogonal to a swing track R of the tip end portion 5C when the weight member 5 swings around the pivot portion 5A. The swing causes the engagement pin 2 to swing around the center of rotation (identical to the center axis O20 of the cam shaft 20) of the flange portion 1B.

Two weight members 5 are swingably provided on side faces of a pair of cam sprockets 15 such that they are symmetric with respect to the center axis O20 of the cam shaft 20. An engagement hole 5*e* is formed in the vicinity of an inner periphery of a central portion of each of the weight members 5. A coil spring 27 is provided between engagement holes 5*e* to bias the weight members 5 to be close to each other. When the cam sprocket 15 is in a non-rotating state, the weigh members 5 are held as shown in FIG. 2A.

As shown in FIGS. 2A, 3A, and 4, a restricting protrusion 6 is formed at an end face of the cam sprocket 15 on which the weight member 5 is provided, and the weight member 5 is provided with an abutment portion 5*g* which is formed at a face of the weight member 5 on which the cam sprocket 15 is provided and abuts with the protrusion 6. When the weight member 5 is swinging outwardly in the radial direction, the abutment portion 5*g* abuts with the protrusion 6. Thereby, further outward swing of the weight member 5 is restricted. A concave portion 5L conforming in shape to a head portion 5*f* of the tip end, portion 5C of one of the weight members 5 is formed at a position slightly apart from the pivot portion 5A of the other weight member 5. The concave portion 5L serves as a restricting protrusion. Specifically, when one of the weight members 5 is swinging inwardly in the radial direction, the concave portion 5L of the other weight member abuts with the hook-shaped head portion 5*f* (side view) of the tip end portion 5C of the one weight member 5. Thereby, further inward swing of the weight member 5 is restricted.

The restricting protrusion comprising the concave portion 5L may be replaced by the head potion of the bolt 17. Specifically, when the weight member 5 is swinging inwardly in the radial direction, a recessed portion 5*r* of the weight member 5 seen in a side view is adapted to abut with the head portion of the bolt 17. Thereby, further inward swing of the weight member 5 is restricted.

As shown in FIGS. 2B, 3B, and 4, the decompression lifter 3 has a partially spherical head portion. The decompression lifter 3 is accommodated in a sleeve 23 fittingly mounted to an accommodating hole 20*e* formed in the cam face 20E such that it is protruded outwardly in the radial direction of the cam shaft, 20 from the cam face 20E or is accommodated inwardly of the cam face 20E in the radial direction by the force of the coil spring 25, that is, a top portion of the head portion of the decompression lifter 3 is as high as the cam face 20E or is retracted in a direction toward the center axis of the shaft 20.

The automatic decompression device so configured functions as follows. Prior to start of the engine, as shown in FIGS. 2A, 2B, the two weight members 5 are biased by the coil spring 27 so that they are close to each other. For this reason, the operating shaft 1 engaged with the weight members 5 via the engagement pins 2, is in the cam shaft 20 as shown in FIG. 2B. Specifically, the circumferential portion of the partial circumferential face 1A of the operating shaft 1 is slidably in contact with the bottom face 3*a* of the decompression lifter 3. Therefore, the decompression lifter 3 is protruded outwardly in the radial direction from the cam face 20A and an abutment portion of the locker arm 10 for exhaust (see FIG. 5) is lifted up. In this state, an exhaust valve (not shown) of the engine is "Open".

In this state, when the engine is started by an electric starter or a hand-operated recoil starter, a pressure in the cylinder is reduced because the interior of the cylinder is opened in atmosphere, which enables start at small rotational torque.

When the engine is started by the electric starter or the hand-operated recoil starter and the number of revolutions of the engine exceeds a predetermined number of revolutions, for example, the number of revolutions in an idling state, the weight member 5 swings around the pivot portion 5A outwardly in the radial direction as shown in FIG. 3A because the centriftgal force acting on the weight member 5 exceeds the spring force from the coil spring 27. In this state, the operating shaft 1 engaged with the weight members 5 via the engagement pins 2 is rotated in the cam shaft 20 and, as shown in FIG. 3B, the bottom face 3*a* of the decompression lifter 3 abuts with the flat face portion 1*a* of the partial circumferential face 1A.

As a result, the head portion of the decompression lifter 3 is accommodated inwardly of the cam face 20A in the radial direction, the locker arm 10 for exhaust abuts with the cam face 20A. The exhaust valve (not shown) of the engine is brought to a "Closed" state and the cylinder is hermetically sealed. In this state, the engine is in a normal operating state. That is, the engine is released from a decompressed state.

With this configuration, even if a rotation angle of the engagement pins 2 with respect to the center of rotation is made sufficiently large as necessary, a swing angle of the weight member 5 is small. Therefore, as shown in FIG. 3A, the weight member 5 is slightly protruded from the outer periphery of the cam sprocket 15. Consequently, a dimension of the decompression control mechanism A in a diameter direction can be reduced.

As shown in FIGS. 4, 5, in the decompression control mechanism A, since the weight member 5 and the cam sprocket 15 are placed close to each other in a thickness direction of the cam sprocket 15, and all the components are placed between them. Therefore, the decompression control mechanism A can also be made compact in the thickness direction of the cam sprocket 15. In particular, because a portion of the side face of the weight member 5 on which the cam sprocket 15 is provided is cut to form a portion 15*f* in which a portion of the protrusion 6 is accommodated, and the abutment portion 5*g* which abuts with the protrusion 6 is situated in the portion 15*f*, the mechanism A has a compact configuration.

In the automatic decompression device according to the invention that functions as described above, since the decompression control mechanism is compactly configured as shown in FIG. 5, the cylinder head portion of the engine can be made compact. Since the head portion of the engine can be made compact, this engine is suitable as the engine mounted on the straddle-type four wheel all terrain vehicle and the degree of freedom at which the engine is mounted is increased.

In addition, since the number of parts and the man-hour for assembly can be reduced as compared to the conventional decompression device, the cost is low.

Numerous modifications and alternative embodiments of the invention will be apparent to those skilled in the art in view of the foregoing description. Accordingly, the description is to be construed as illustrative only, and is provided for the purpose of teaching those skilled in the art the best mode of carrying out the invention. The details of the structure and/or function may be varied substantially without departing from the spirit of the invention and all modifications which come within the scope of the appended claims are reserved.

What is claimed is:

1. An automatic decompression device of a small OHC engine in which a decompression lifter provided inwardly of an exhaust cam face of a cam shaft in a radial direction of the cam shaft such that the decompression lifter is outwardly protrusive or inwardly retractable in the radial direction from the cam face, by rotational operation of an operating shaft inserted concentrically with the cam shaft in the cam shaft, is protruded by a decompression control mechanism when the number of revolutions of the cam shaft is below a predetermined number of revolutions, for reducing a pressure in a cylinder when the engine is starting, wherein the decompression control mechanism comprises:

a pair of weight members provided at an end portion of the cam shaft, the weight members each including a pivot portion pivotably attached to the cam shaft at a position apart from a center axis of the cam shaft such that pivot portions of the weight members are provided to be symmetric with respect to the center axis and a tip end portion engaging with the operating shaft and extending toward an opposite side of the pivot portion of the weight member with respect to the center axis; and a bias member for biasing each of the weight members in a swing area of the weight members.

2. The automatic decompression device of a small OHC engine according to claim 1, wherein the bias member is comprised of a coil spring substantially passing through the center axis and placed between the weight members to bias the weight members to be close to each other.

3. The automatic decompression device of a small OHC engine according to claim 1, further comprising:

a cam sprocket for driving the cam shaft, the cam sprocket formed integrally with an end portion of the cam shaft so as to be rotatable with the cam shaft, wherein the weight members are pivotally attached to a side face of the cam sprocket, and first restricting protrusions are provided on a side face of the cam sprocket on the weight member side and abutment portions are provided on the side faces of the weight members on the cam sprocket side, wherein the restricting protrusions abut with the abutment portions to restrict swing of the weight members.

4. The automatic decompression device of a small OHC engine according to claim 3, wherein a second restricting protrusion that restricts swing of one of the weight members is formed of a portion of the other weight member.

5. The automatic decompression device of a small OHC engine according to claim 1, wherein the weight members are symmetric with respect to the center axis of the cam shaft.

6. The automatic decompression device of a small OHC engine according to claim 1, wherein the decompression lifter is protruded to allow an exhaust rocker arm to be operated for reducing a pressure in a cylinder.

7. The automatic decompression device of a small OHC engine according to claim 1, further comprising:

a cam sprocket for driving the cam shaft, the cam shaft formed integrally with an end portion of the cam shaft so as to be rotatable with the cam shaft, wherein the weight members are pivotally attached to a side face of the cam sprocket.

8. The automatic decompression device of a small OHC engine according to claim 7, wherein a second restricting protrusion that restricts swing of one of the weight members is formed of a portion of the other weight member.

9. The automatic decompression device of a small OHC engine according to claim 7, wherein when the weight members swing inwardly, outer peripheries of the weight members are located inwardly of an outer periphery of the cam sprocket.

10. The automatic decompression device of a small OHC engine according to claim 7, wherein the tip end portion of the one weight member is located on a radially inner side the other weight member.

11. The automatic decompression device of a small OHC engine according to claim 9, further comprising a flange provided at an end portion of the operating shaft, pins protruded from a side face of the flange, and engagement grooves formed at tip ends of the weight members, wherein the operating shaft rotates so as to operate the decompression lifter by swing of the weight members in a state in which the pins engage with the engagement grooves.

* * * * *

UNITED STATES PATENT AND TRADEMARK OFFICE

CERTIFICATE OF CORRECTION

PATENT NO. : 6,543,403 B2
DATED : April 8, 2003
INVENTOR(S) : Yuichi Kawamoto

It is certified that error appears in the above-identified patent and that said Letters Patent is hereby corrected as shown below:

Title page,
Item [22], Filed, "Apr. 25, 2001" should be changed to -- Jan. 29, 2001 --.

Signed and Sealed this

Thirtieth Day of December, 2003

JAMES E. ROGAN
*Director of the United States Patent and Trademark Office*